US005725086A

United States Patent [19]

Cooper

[11] Patent Number: 5,725,086

[45] Date of Patent: Mar. 10, 1998

[54] HAND TOOL

[75] Inventor: Vince Cooper, Durham City, United Kingdom

[73] Assignee: Black & Decker Inc., Newark, Del.

[21] Appl. No.: 561,762

[22] Filed: Nov. 22, 1995

[30] Foreign Application Priority Data

Nov. 25, 1994 [GB] United Kingdom ..... 9423847

[51] Int. Cl.[6] ..... H01H 19/06

[52] U.S. Cl. ..... 200/302.3; 200/302.1

[58] Field of Search ..... 200/302.3, 302.1, 200/339, 302.2, 552

[56] References Cited

U.S. PATENT DOCUMENTS

| | | | |
|---|---|---|---|
| 3,654,415 | 4/1972 | Hawkins et al. | 200/302.3 |
| 4,520,247 | 5/1985 | Pancook et al. . | |
| 5,448,028 | 9/1995 | Filion et al. | 200/302.1 |

FOREIGN PATENT DOCUMENTS

| | | |
|---|---|---|
| 1861084 | 11/1952 | Germany . |
| 1780679 | 5/1958 | Germany . |
| 1490050 | 7/1969 | Germany . |

*Primary Examiner*—David J. Walczak

*Attorney, Agent, or Firm*—Bruce S. Shapiro; Dennis A. Dearing; John D. Del Ponti

[57] ABSTRACT

A key pad (6) is provided for the on/off switch for a powered hand tool (2) in which the on/off switch is of the rocker type in which the switch mechanism is actuated by a rocker member (16) comprising two rocker components (18,20) pivoted about a pivot point (22) and is switched by applying pressure selectively to one of the two rocker components (18,20). The key pad (6) forms a sealed cover for the rocker switch (16) and is moulded from a resilient material, and comprises a pair of actuator pads (8,10), each of which actuator pads (8,10) is associated with a corresponding rocker component (18,20) of the rocker switch (16) and is moulded as a relatively thick pad section (8,10) linked to the key pad wall (12) by a relatively thin deformable circumferential linking section (14) and can be selectively switched between a first stable position and a second stable position in which the actuator pad (8,10) is depressed relative to the first stable position.

3 Claims, 2 Drawing Sheets

HAND TOOL

Figure 1:
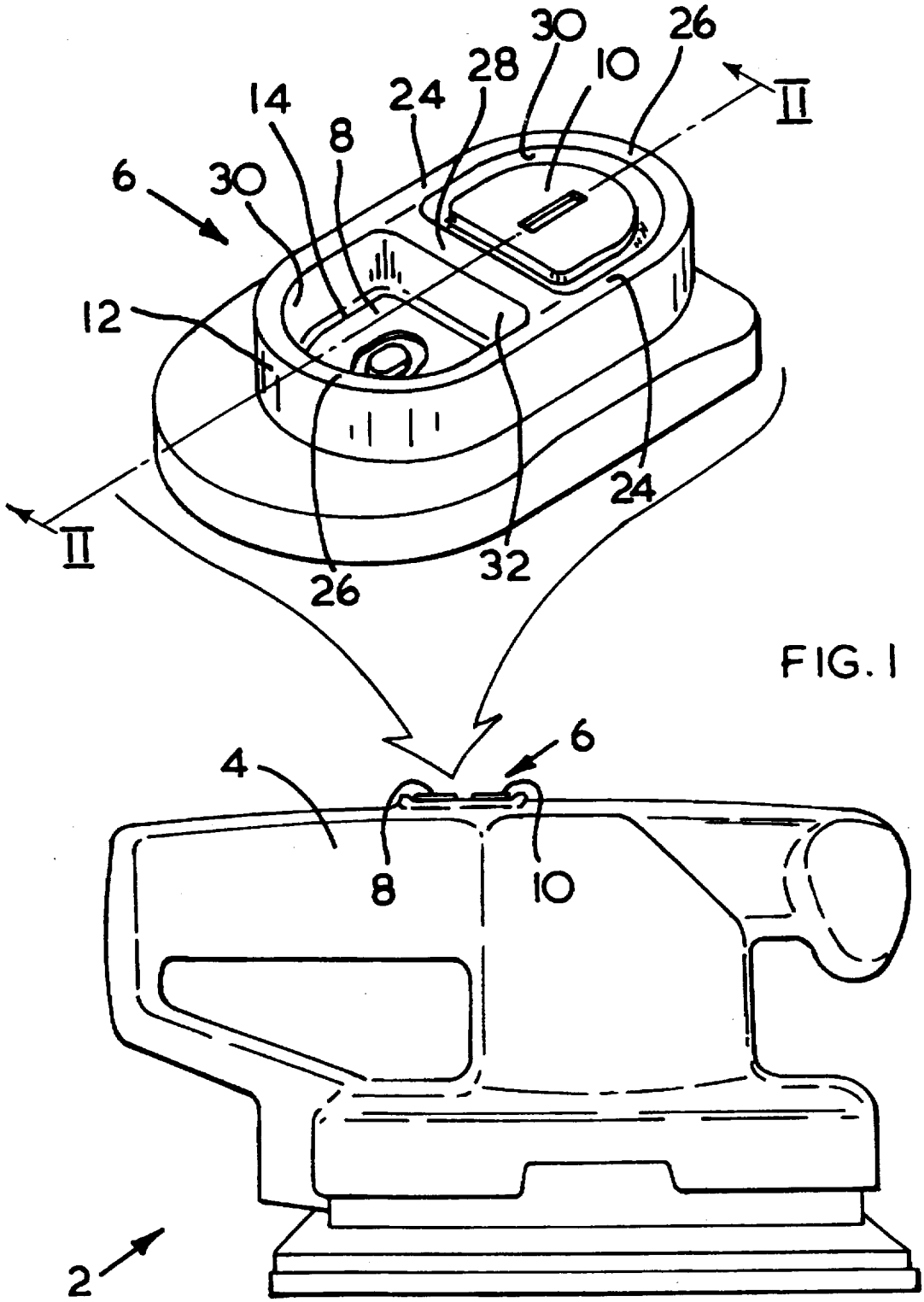

The present invention relates to a improved key pad for the on/off switch for a powered hand tool, and is particularly suitable for a key pad for the on/off switch for a tool which is to be used in a dust-laden or dirty environment, for example a powered sander, planer or jigsaw.

A number of designs are known for the on/off switches for powered hand tools, and these fall broadly into one of two types.

The first type comprise switches of the slider type which have good appearance from an aesthetic point of view but which are not acceptable from the point of view of dust ingress as they are not sealed.

The second type of known switches comprise rocker switches, which have to be sealed with a seal made, for example, of rubber, for use in a dust-laden or dirty environment. While these switches have the advantage that they are sealed against the ingress of dust or other dirt, they have the disadvantage that they are difficult to operate, switch disposition can be difficult to ascertain prior to applying power to the unit and the switches are of poor aesthetic appearance.

It is an object of the present invention to provide a key pad for the on/off switch for a powered hand tool in which the above disadvantages are reduced or substantially obviated.

The present invention provides a key pad for the on/off switch for a powered hand tool in which the on/off switch is of the rocker type in which the switch mechanism is actuated by a rocker member comprising two rocker components pivoted about a pivot point and is switched by applying pressure selectively to one of the two rocker components, characterised in that the key pad forms a sealed cover for the rocker switch and is moulded from a resilient material, and comprises a pair of actuator pads, each of which actuator pads is associated with a corresponding rocker component of the rocker switch and is moulded as a relatively thick pad section linked to the key pad wall by a relatively thin deformable circumferential linking section and can be selectively switched between a first stable position and a second stable position in which the actuator pad is depressed relative to the first stable position.

In a preferred embodiment of a key pad according to the invention, in the first stable position, the actuator pad is substantially coplanar with the surrounding key pad wall and in the second stable position the actuator pad is depressed relative to the surrounding key pad wall.

In a particularly preferred embodiment of a key pad according to the invention, each of the actuator pads is provided with identifying marking. In order to correspond with international guidelines , the actuator pad which is in the relatively depressed position when the switch is in the 'ON' configuration should be marked 'I' and the actuator pad which is in the relatively depressed position when the switch is in the 'OFF' configuration should be marked '0'.

It is a particularly advantageous feature of the key pad according to the invention that the switch disposition can be easily and reliably ascertained prior to applying power to the unit.

Figure 2:
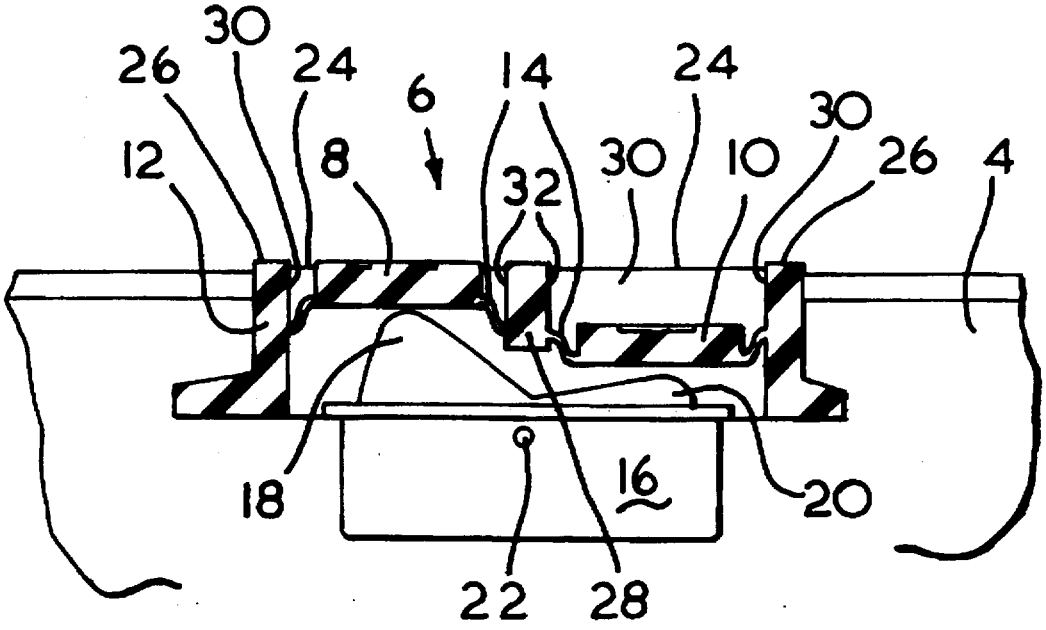
Figure 3:
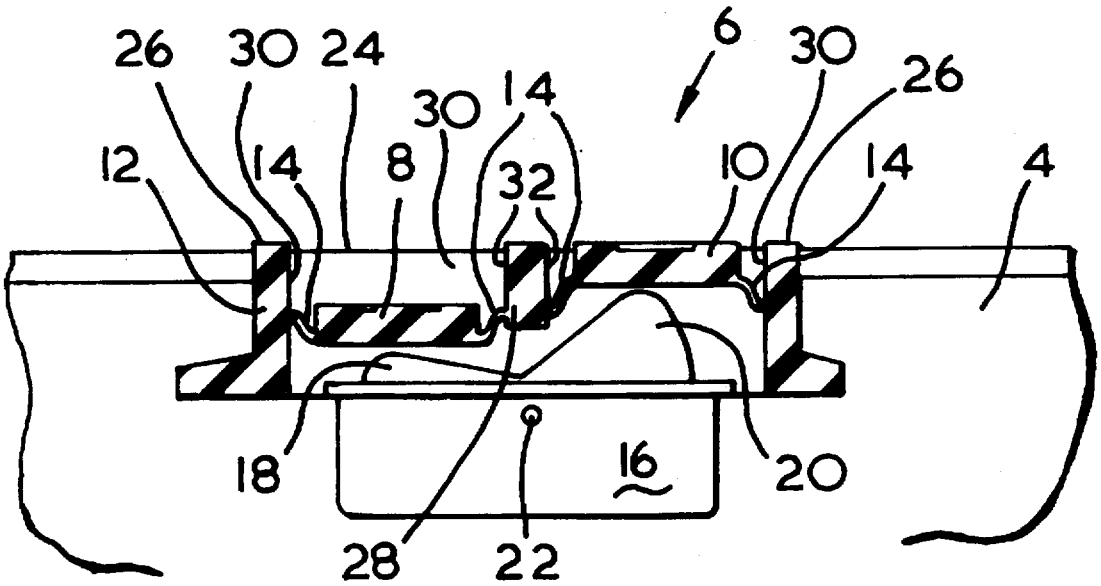

The invention will now be described with reference to the accompanying drawings, in which FIG. 1 is a perspective view of an embodiment of a key pad according to the invention, shown in situ in the housing of a powered hand tool, the scale of the key pad being enlarged relative to that of the hand tool;

FIG. 2 is a section on the line II—II of FIG. 1, showing the first actuator pad in the first stable position and the second actuator pad in the second stable position and FIG. 3 is a similar view to that of FIG. 3 showing the first actuator pad in the second stable position and the second actuator pad in the first stable position.

As can be seen from FIG. 1, a powered sander shown generally at 2 includes a handle portion 4. A key pad 6 is located in the handle portion 4 and comprises first and second actuator pads 8,10 and a surrounding key pad wall 12. A deformable section 14 surrounds each of the actuator pads 8,10, linking the actuator pads 8,10 with the key pad wall 12. The first actuator pad 8 is marked with the symbol '0' and the second actuator pad 10 is marked with the symbol 'I'.

FIG. 2 shows the key pads 6 with an associated rocker member 16, in the 'ON' configuration. The rocker member 16 which is of known design, comprises first and second rocker elements 18,20 pivoted about a pivot point 22. The first rocker element 18, which is associated with the first actuator pad 8 is shown in a relatively raised disposition and the second rocker element 20, which is associated with the second actuator pad 10 is shown in a relatively depressed disposition.

FIG. 3 shows the key pad 6 with an associated rocker member 16, in the 'OFF' configuration. The rocker member 16 comprises first and second rocker elements 18,20 pivoted about a pivot point 22. The first rocker element 18, which is associated with the first actuator pad 8 is shown in a relatively depressed disposition and the second rocker element 20, which is associated with the second actuator pad 10 is shown in a relatively raised disposition.

As shown in FIG. 1, the key pad wall 12 is formed generally with straight side walls 24 on opposite sides thereof which are joined by semi-circular end walls 26 at opposite ends thereof. As shown in FIGS. 1, 2 and 3, the key pad wall 12 is further formed with a separator beam 28 which extends between the intermediate portions of the side walls 24. As shown in FIGS. 2 and 3, the deformable sections 14 associated with each of the actuator pads 8 and 10 are joined integrally on three sides thereof with an inside surface 30 of the key pad wall 12. A fourth side of each of the deformable sections 14 is joined integrally with opposite side surfaces 32 of the beam 28.

Further, the deformable sections 14 join integrally with the respective pads 8 and 10 at the juncture of the sides and bottom surface of the pads and each deformable section has a bottom surface which is a continuation of the bottom surface of the respective pad. The side walls 24, end walls 26 and the beam side surfaces 32 of the key pad wall 12 are much thicker than the deformable sections 14 and are arranged generally perpendicular to the outer surface of the handle portion 4. The deformable sections 14 join and extend generally perpendicular from, and at their precise juncture with, the much stronger and thicker side walls 24, end walls 26 and side surfaces 32.

As can be seen from FIGS. 2 and 3, in each of the stable switched positions, i.e. in both the 'ON' and the 'OFF' configurations, there is no contact between either of the rocker elements 18,20 and their corresponding actuator pads 8,10. Wear on the actuator pads 8,10 is thus reduced, as is the risk of unintentional switching of the tool.

In order to switch the powered tool from the 'ON' configuration shown in FIG. 2 to the 'OFF' configuration shown in FIG. 3, pressure is applied to the relatively raised first actuator pad 8 which is then depressed so that the pressure is applied through the material of the pad 8 to the first rocker element 18. This rocker element 18 is then displaced into its depressed position (as shown in FIG. 3) and the actuator pad 8 also is displaced into its second position. By pivoting about the pivot point 22, the second rocker element 20 is displaced from its relatively depressed position into its relatively raised position. During this displacement, the second rocker element 20 contacts the undersurface of the second actuator pad 10 and displaces it from its second, relatively depressed, position to its first, relatively elevated position (as shown in FIG. 3).

I claim:

1. A key pad for an on/off switch of a powered device wherein the switch includes a rocker element with two rocker components which are pivoted about a pivot point by applying pressure selectively to one of the two rocker components, which comprises:

a continuous wall of a prescribed height and a prescribed thickness which forms a cell having an inner side surface extending continuously around the cell;

a beam extending across an intermediate portion of the cell to form a first compartment and a second compartment enclosed within the continuous wall and defined by the beam;

the beam having a first side surface and a second side surface on opposite sides of the beam which interface with the portions of the inner side surfaces of the continuous wall to further define the first and second compartments, respectively;

a first actuator pad having side edges and located within the first compartment;

a first deformable section of the first actuator pad integrally formed with an intermediate portion of the inner side surface of the continuous wall and with an intermediate portion of the first side surface of the beam which combine to form an inner wall surface of the first compartment;

the first deformable section of a thickness less than the prescribed thickness formed integrally with and extending outward from the side edges of the first actuator pad;

a second actuator pad having side edges and located within the second compartment;

a second deformable section of a thickness less than the prescribed thickness formed integrally with and extending outward from the side edges of the second actuator pad;

the second actuator pad integrally formed with an intermediate portion of the inner side surface of the continuous wall and with an intermediate portion of the second side surface of the beam which combine to form an inner wall surface of the second compartment; and the first actuator pad being located over a first of the two rocker components for engagement therewith and the second actuator pad being located over a second of the two rocker components for engagement therewith when a pressure is applied against the first and second actuator pads inward of the first or second compartments, respectively.

2. The key pad as set forth in claim 1, which further comprises:

each of deformable section extending from a lowest portion of the edges of the respective actuator pad contiguous with the juncture of the edges of the actuator pad and a bottom surface thereof.

3. The key pad as set forth in claim 2, which further comprises:

the bottom surface of each actuator pad and an under surface of the respective deformable section being a continuous surface.

* * * * *